US008230845B2

(12) United States Patent
Hilpert

(10) Patent No.: US 8,230,845 B2
(45) Date of Patent: Jul. 31, 2012

(54) DEVICE FOR SEPARATING FLUID PARTICLES FROM A GAS FLOW LEAKING FROM A CRANKCASE

(75) Inventor: Torsten Hilpert, Erdmannhausen (DE)

(73) Assignee: Mann+Hummel GmbH, Ludwigsburg (DE)

( * ) Notice: Subject to any disclaimer, the term of this patent is extended or adjusted under 35 U.S.C. 154(b) by 572 days.

(21) Appl. No.: 12/294,248

(22) PCT Filed: Mar. 16, 2007

(86) PCT No.: PCT/EP2007/052502

§ 371 (c)(1),
(2), (4) Date: Nov. 6, 2009

(87) PCT Pub. No.: WO2007/110332

PCT Pub. Date: Oct. 4, 2007

(65) Prior Publication Data

US 2010/0043763 A1 Feb. 25, 2010

(30) Foreign Application Priority Data

Mar. 24, 2006 (DE) ..... 20 2006 004 897 U

(51) Int. Cl.
*F02B 25/06* (2006.01)

(52) U.S. Cl. ..... 123/573; 123/342; 123/572

(58) Field of Classification Search ..... 123/573, 123/572, 342

See application file for complete search history.

(56) References Cited

U.S. PATENT DOCUMENTS 1,890,070 A * 12/1932 Whiton, Jr. ..... 96/400
6,942,709 B2 * 9/2005 Trautmann et al. ..... 55/346
7,159,723 B2 * 1/2007 Hilpert et al. ..... 209/710

* cited by examiner

*Primary Examiner* — Marguerite McMahon
*Assistant Examiner* — James Kim
(74) *Attorney, Agent, or Firm* — James Hasselbeck

(57) ABSTRACT

The invention concerns a device for separating fluid particles from a gas flow, in particular from a crankcase gas flow of an internal combustion engine. A valve is provided to allow a distribution of the gas flow to at least two cyclones depending on the volumetric flow. The valve consists of a cylinder through which the gas can flow. Inside the cylinder is a piston. This piston is designed inside the cylinder with a clearance fit or provided with one or several boreholes. In case of a low gas flow and because of the tolerances or boreholes, this gas flow will be directed around the cylinder to a first cyclone. When exceeding a certain volumetric flow the piston moves inside the cylinder and opens at least one more cyclone for the gas flow to flow through.

9 Claims, 4 Drawing Sheets

DEVICE FOR SEPARATING FLUID PARTICLES FROM A GAS FLOW LEAKING FROM A CRANKCASE

Figure 1:
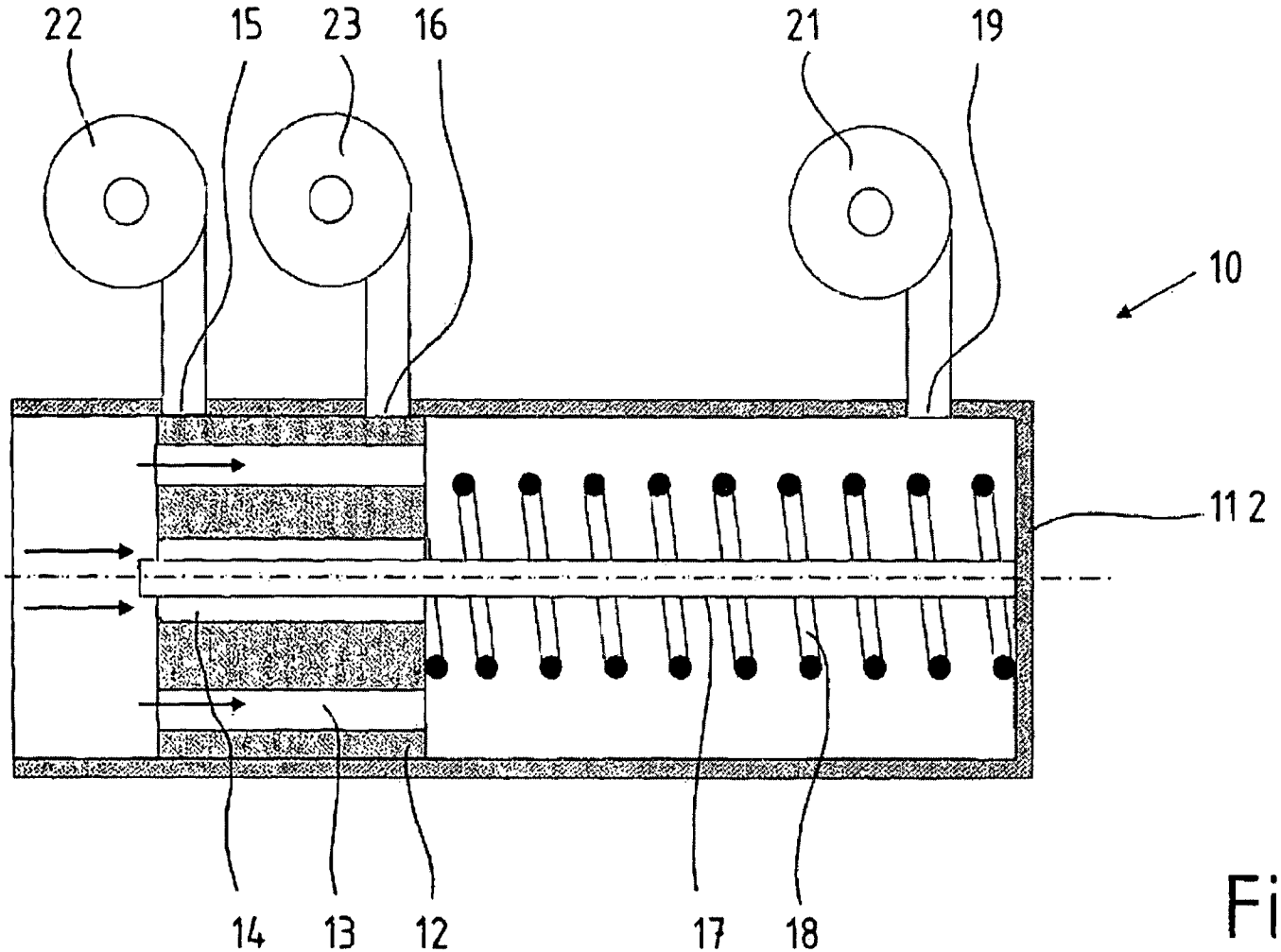

The invention concerns a device for separating fluid particles from a gas flow leaking from a crankcase with a valve element for a volumetric-flow-depending division of the gas flow to at least two fluid-separating devices.

A method is known from EP 1 090 210 B1 including the appropriate device through which a load-dependent division of a gas flow, in particular of crankcase ventilation gases, is known. In this connection, several cyclones are provided as fluid-separating devices which are connected in parallel or in series in different combinations. It is intended to divide the fluid flow into partial flows, a first partial flow being delivered to a first fluid-separating device which is permanently engaged and ensures a basic load operation. In case of higher volumetric flows a non-return valve opens the way to a second fluid-separating device. However, this theoretically imaginable basic concept is difficult to realize practically as for example only minor differential pressures occur between the operating conditions.

Precisely when the non-return valve opens because of an additional load, the gas flow is suddenly divided into two partial gas flows, generating again a decrease in pressure so that the non-return valve closes again immediately. The performance of the known device is therefore very unstable. Furthermore, the individual elements for dividing a volumetric flow and the valve elements for the activation in case of a peak load must be connected with each other by means of additional hose or tube sections which requires much additional installation space.

It is the aim of the invention to improve a well-known device for separating fluid particles from a gas flow, which leaks mainly from a crankcase, to such a point that a more stable and vibration-low performance is obtained and at the same time less installation space is needed.

This task is solved by a device with the features of claim 1.

The piston-cylinder arrangement for which a loose clearance fit between piston and cylinder is provided for from the beginning allows a very compact design which can moreover be manufactured in an easy and low-cost manner of injected plastic pieces. The geometric tolerances to be included in injection molded parts are a priori accepted according to the invention and incorporated in an advantageous manner by deliberately causing leakage flows along the piston to lead—in basic load operation—a gas flow to the off-flow side of the valve element and from there to a fluid-separating device. Furthermore, the leakage flow around the piston can be increased by means of an annular gap that becomes increasingly larger along-side the piston stroke. The pressure drop associated with an increasingly growing volumetric flow can now be limited by the piston.

The leakage flows can also be influenced by making other sections of the axial cross-sectional area of the piston gas-permeable, for example by axial boreholes or grooves in the cylindrical piston wall.

To carry out fine adjustments it can also be envisaged to make some boreholes closeable to influence the system's switching behavior in coordination with the spring rate.

During a basic load operation the piston of the device according to the invention does not move axially. However, if the volumetric flow of the gases to be deoiled increases the dynamic pressure at the piston—which forms a flow obstacle at the crude gas side—increases and moves it against the spring force; this releases the radial aperture in the cylinder wall, thus allowing the crude gas to flow in directly. It is also advantageous that the activation of the second fluid-separating device does not occur abruptly, but that the bifurcated volumetric flow increases continuously, for the piston opens only a small gap in the aperture at the beginning, making then available more and more opening space the more the shifting movement increases.

It is preferably intended to make the second fluid-separating device, which is activated when the piston moves, more performing in comparison with the first fluid-separating device and to chose the dimensions of the aperture's cross sections with the subsequent branch line up to the second fluid-separating device accordingly, so that virtually the complete volumetric flow of the crude gas is led into the second fluid-separating device where it is deoiled and that only a negligible residual flow passes through the flow obstacle created by the piston and reaches the first fluid-separating device. The valve element according to the invention acts quasi as changeover switch on the second and more performing separation device which in particular is designed as an already known cyclone for separating oil from crankcase ventilation gases. Due to the changeover, virtually the complete volumetric flow accumulates at the crude gas side of the piston and causes such a dynamic pressure that the piston remains in displaced position until the operating condition of the upstream internal combustion engine changes again and a basic load operation is reached. Because of the force generated by a return device, in particular by a spring, the piston returns to its initial position; the additional fluid-separating devices are then little by little switched off and the basic load flow again passes the piston and reaches the first fluid-separating device.

According to this embodiment it may be intended to provide for one or several more fluid-separating devices and to supply them via additional apertures which are arranged downstream with respect to the first aperture. Consequently three operating conditions could be reached altogether:

- During the first operating condition, a small gas flow passes the piston to reach the first fluid-separating device.
- During a second operating condition with a higher volumetric flow, the second fluid-separating device is activated.
- If ever additional peak loads occur, then the third fluid-separating device can be activated.

The advantage of the system according to the invention is in particular the fact that the volumetric flows depend on each other and that they are divided only via a common switch element which is the piston in the cylinder. In addition to a mere activation, which is also provided for according to prior art, a changeover according to the invention is also possible, as described above, that is to say if the piston serves as flow obstacle and if the size of the first aperture including the second fluid-separating device are designed such that after a change-over no significant gas flow passes the piston and reaches the first fluid-separating device.

Basically, a uniform division can also be provided for so that—in case the second fluid-separating device is activated—both fluid-separating devices each can be reached by an approximate equal gas flow.

The piston can be axially guided along a guide element, for example along a guide rod centrally fixed in the cylinder.

The invention will be described more in detail hereinafter by means of drawings. The figures show different operating conditions in a schematic sectional view.

Shown are in:

FIG. 1 a valve element in basic load operation.

Figure 2:
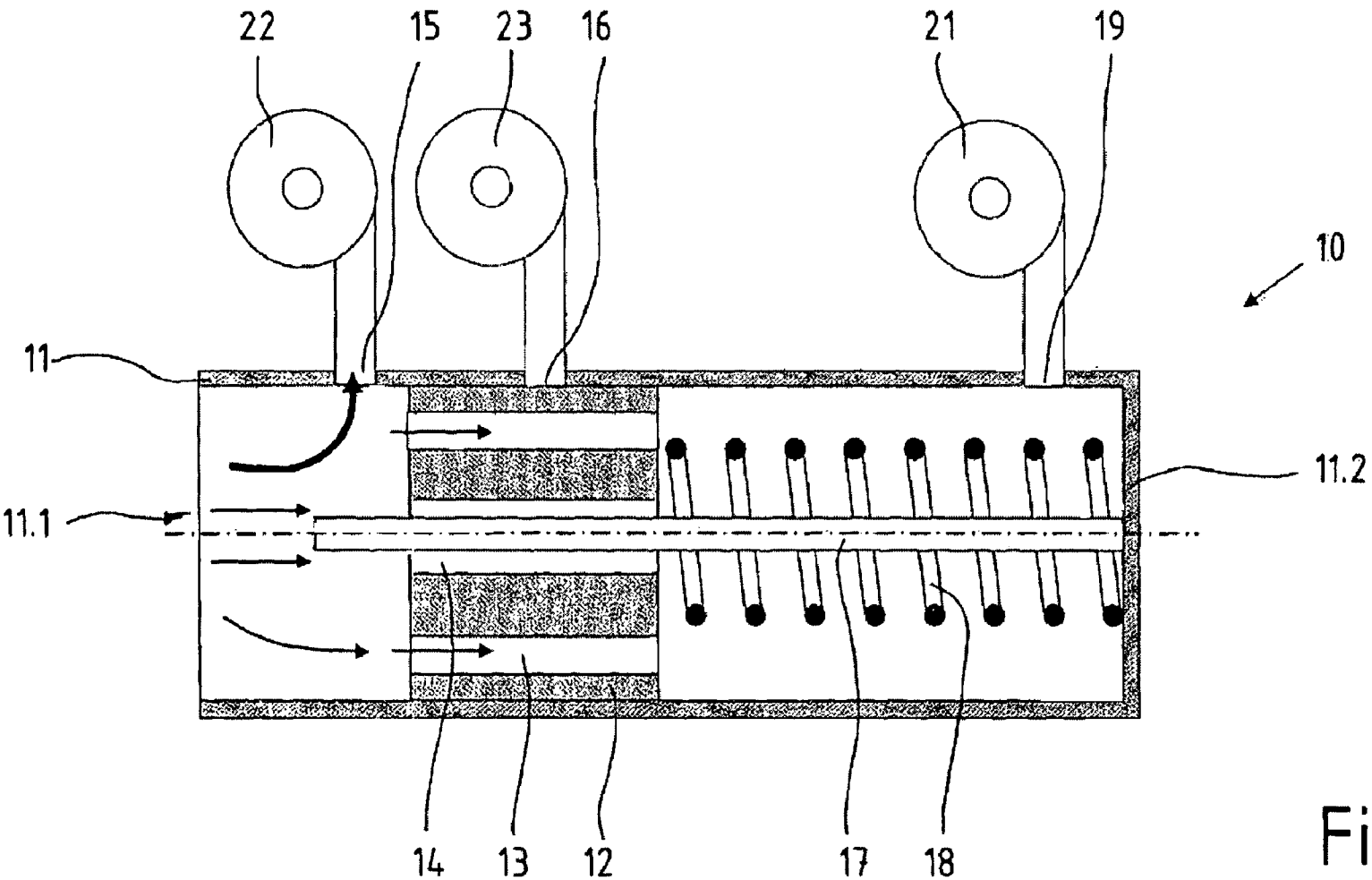

FIG. 2 a valve element in average load operation.

Figure 3:
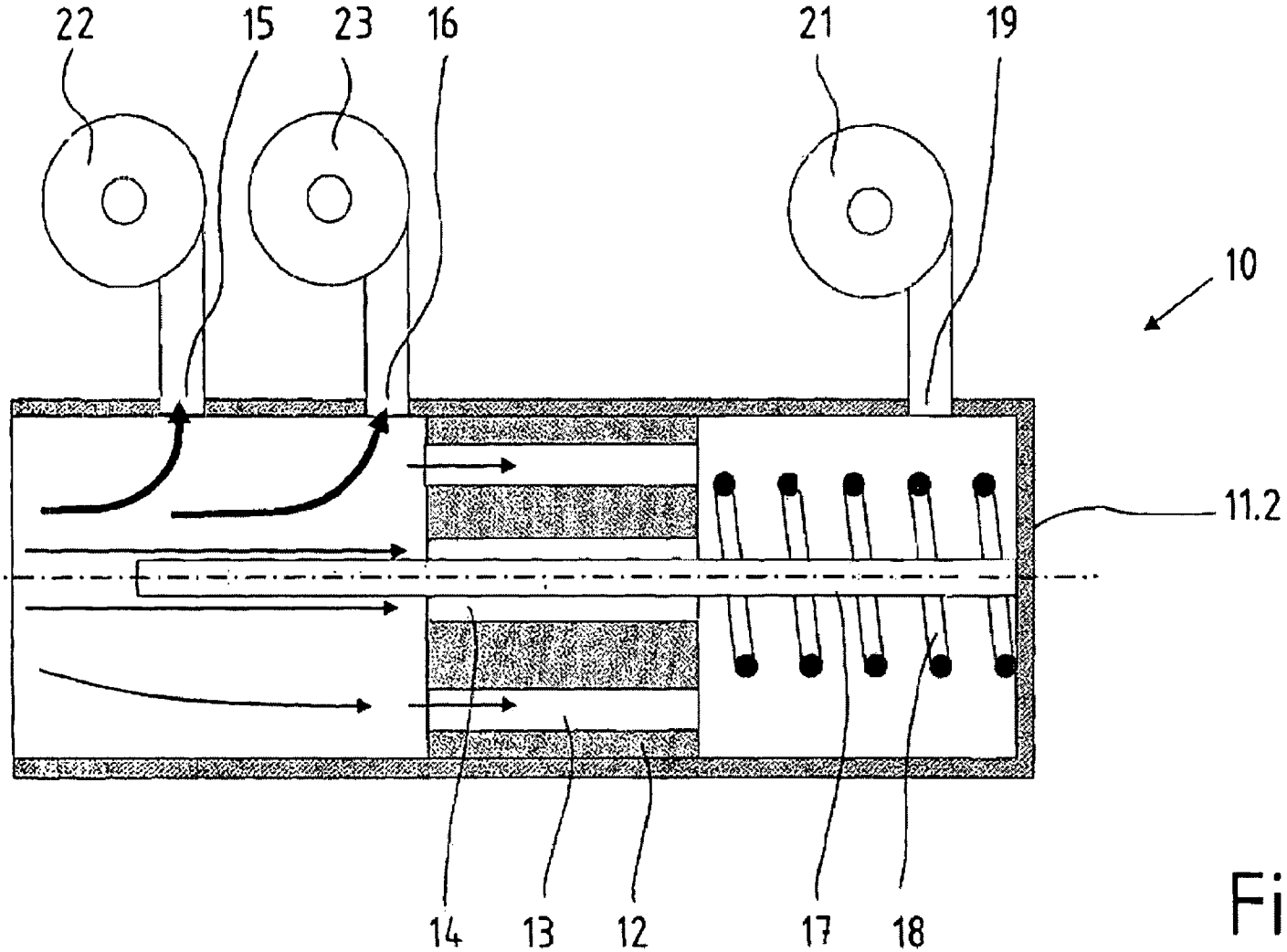

FIG. 3 a valve element in full load operation.

Figure 4:
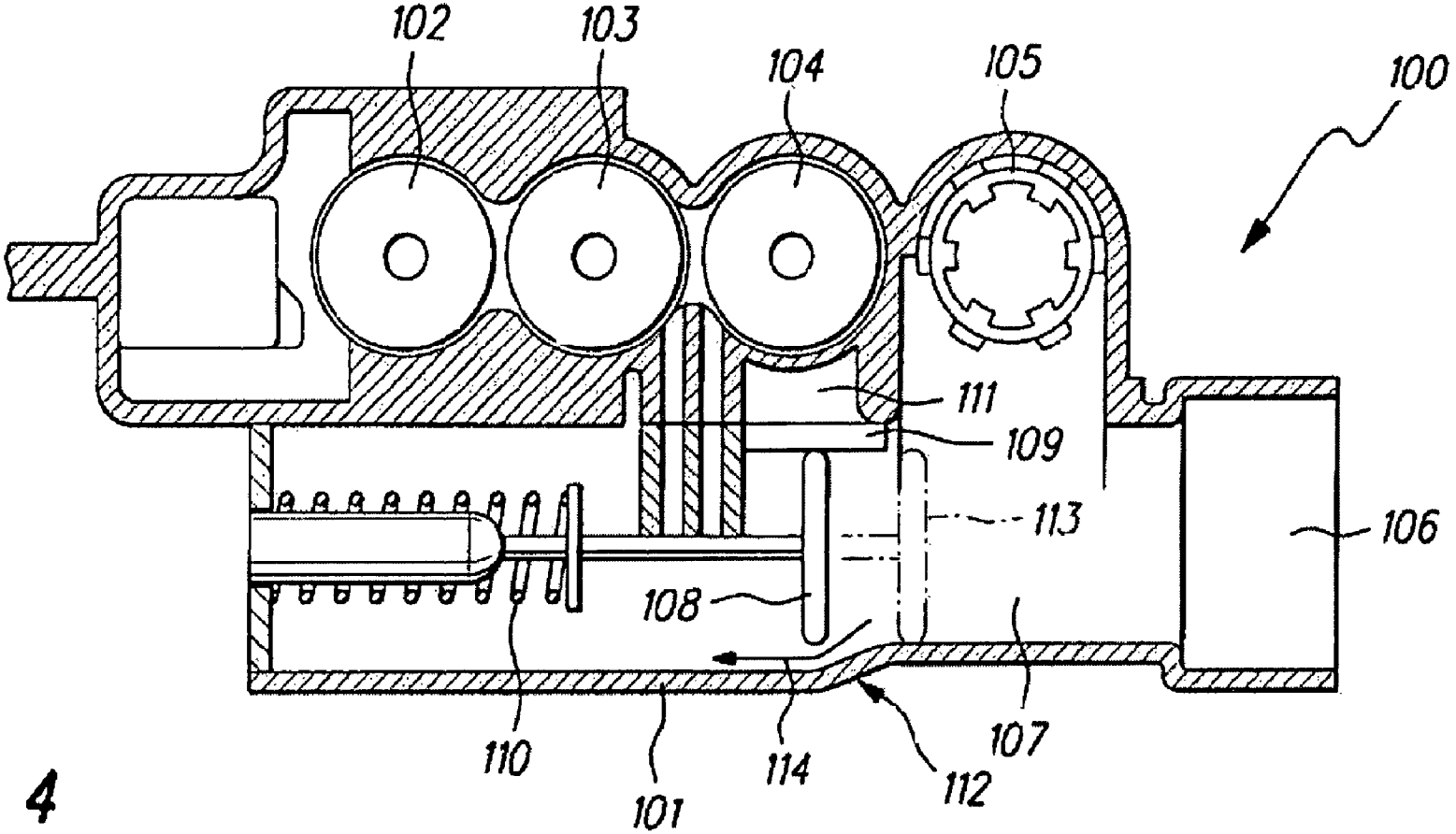

FIG. 4 another variant of a valve element.

It consists basically of a cylinder 11 which is open at its crude gas side 11.1 and closed at its off-flow side in the shown example of an embodiment. The cylinder 11 features in its cylinder jacket several axially spaced apertures 15, 16, 19 from which branch lines lead to cyclones 21, 22, 23 as fluid-separating devices.

Inside the cylinder 11 a piston 12 is arranged movably. The piston 12 features a central borehole 14 into which a guide rod 17 which is firmly connected with the cylinder 11 is introduced. At the off-flow side of the piston is arranged a compression spring 18 which rests on the bottom 11.2 of the cylinder 11. Moreover, the piston features several axial boreholes 13 to allow the gas flow intended for the basic load operation.

The functioning of the device according to the invention is once more explained in the following by means of FIGS. 1 to 3:

In basic load operation the piston takes the position shown in FIG. 1. A leakage flow passes the piston in the peripheral zone as well as through the boreholes 13, 14 and exits through the aperture 19 to enter a first cyclone 21.

If the dynamic pressure increases at the crude gas side 11.1 at the piston's end face it is then—as shown in FIG. 2—deviated against the force of the spring 18 and opens the aperture 15, allowing the crude gas to flow into the second cyclone 22. The thickness of the arrows indicates the proportion of each partial flow.

If the pressure increases even more at the crude gas side 11.1 the piston 12 is finally moved to such an extent (cf. FIG. 3) that the second aperture 16 also opens, allowing the gas to flow into the third cyclone 3.

Depending on the design and tuning of the device either all three cyclones 21, 22, 23 are engaged or the first cyclone 21 for the basic load operation is out of service except for a negligible residual gas flow, whereas the main load is equally distributed to the cyclones 22 and 23.

In FIG. 4 another variant of a valve element 100 is shown. It features a housing 101 in which three cyclones 102, 103, 104 as well as a pressure relief valve are arranged. The housing has a crude gas intake 106 from where extents a cylindrical area 107. In the cylindrical area a piston 108 is movably arranged in longitudinal direction. The piston is guided alongside a laterally arranged linear guiding 109 which is for example designed as dovetail guiding. At the left side, the piston is supported by a spring 110. In the position shown here, the piston opens the cyclone intake port 111 of cyclone 104 allowing the uncleaned gas to flow into this cyclone to be deoiled. The cylindrical area 107 has a so-called tulip-shaped section 112 which extents along the piston's displacement path. If the piston is in the rest position at the right side—shown by the dotted representation 113—this tulip-shaped section and piston bypass is closed. If—due to the dynamic pressure—the piston moves to the left, it opens a bypass according to arrow 114 in the tulip-shaped section allowing crude gas to flow also to cyclone 102. This tulip-shaped section has the advantage that a targeted leakage flow that bypasses the piston 108 can be realized.

As already shown in FIG. 3, the piston moves to the left and opens also cyclone 103 if the dynamic pressure increases. The pressure relief valve 105 ensures that a certain proportion can be discharged via this pressure relief valve if the crude gas pressure is extremely high.

The invention claimed is:

1. Device for separating fluid particles from a gas flow leaking from a crankcase with a valve element (10) for a volumetric-flow-depending division of the gas flow to at least two fluid-separating devices (21, 22), characterized in that the valve element (10) comprises a cylinder (11) which is through-flowable by the gas flow and connected at the off-flow side with a first fluid-separating device (21) and the cylinder jacket of which features at least a first aperture (15) of a branch line leading to a second fluid-separating device (22), that between the cylinder (11) and the piston (12) a clearance fit is designed and/or that the piston is provided for with at least one axial borehole (13, 14), and that in the cylinder (11) a piston element (12) is arranged which in an initial condition covers the at least one aperture (15) and which is—due to the dynamic pressure—movable against the force of a return device (18) by opening the aperture (15).

2. Device according to claim 1, characterized in that a third fluid-separating device (23) is provided for which is connected with a second aperture (16) in the cylinder jacket which is axially spaced to the first aperture (15) and covered by the piston element (12) in the initial condition.

3. Device according to claim 1 or 2, characterized in that the piston element (12) with an axial borehole (14) is guided along a guiding element (17).

4. Device according to claim 1 or 2, characterized in that the piston element (12) is guided via a rail at the cylinder (11).

5. Device according to one of the claims 1 to 4, characterized in that the cylinder (11) is closed at its off-flow side (11.2) and that the first fluid-separating device is connected with a third aperture (19) in the cylinder jacket which can not be covered by the piston element (12).

6. Device according to one of the claims 1 to 5, characterized in that the return device is a spring (18).

7. Device according to one of the claims 1 to 6, characterized in that the fluid-separating devices (21, 22, 23) are designed as cyclones.

8. Device according to claim 1, characterized in that the piston and/or the housing 101 are designed such that a leakage flow can pass around the piston.

9. Device according to claim 8, characterized in that a tulip-shaped section 112 for the bypass of a leakage flow is provided at the housing 101.

* * * * *